US007859472B2

(12) United States Patent
Tsurume

(10) Patent No.: US 7,859,472 B2
(45) Date of Patent: Dec. 28, 2010

(54) GLASS ANTENNA FOR VEHICLE

(75) Inventor: Yoshinobu Tsurume, Tokyo (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 104 days.

(21) Appl. No.: 12/173,991

(22) Filed: Jul. 16, 2008

(65) Prior Publication Data

US 2009/0058742 A1 Mar. 5, 2009

(30) Foreign Application Priority Data

Sep. 5, 2007 (JP) ..... 2007-230428

(51) Int. Cl.
*H01Q 1/32* (2006.01)

(52) U.S. Cl. ..... 343/713

(58) Field of Classification Search ..... 343/704, 343/713

See application file for complete search history.

(56) References Cited

U.S. PATENT DOCUMENTS 7,106,262 B2 * 9/2006 Baranski ..... 343/713

FOREIGN PATENT DOCUMENTS

JP 2001-136013 5/2001

* cited by examiner

*Primary Examiner*—Michael C Wimer
(74) *Attorney, Agent, or Firm*—Rankin, Hill & Clark LLP

(57) ABSTRACT

A glass antenna for a vehicle has exceptional impedance matching characteristics and makes it possible to obtain good reception sensitivity even when the area of the vehicle window glass is small. The glass antenna includes an antenna element formed on the window glass and a feeder terminal and ground terminals connected to the antenna element. The antenna element comprises parallel rectilinear conductor elements extending from the respective terminals and connecting conductor elements for connecting these conductor elements. The feeder terminal is connected to a coaxial cable, and the ground terminals are respectively connected to the vehicle body via feeder lines.

6 Claims, 7 Drawing Sheets

ANTENNA RADIATION IMPEDANCE CHARACTERISTICS (SMITH CHART)

GLASS ANTENNA FOR VEHICLE

FIELD OF THE INVENTION

The present invention relates to a vehicular glass antenna for and, in particular, to vehicular glass antenna for a VHF band.

BACKGROUND OF THE INVENTION

In the past, glass antennas for vehicles in which a VHF band antenna is formed on the window glass of the vehicle have been known, as disclosed for example in Japanese Patent Application Laid-Open Publication No. 2001-136013 (JP 2001-136013 A).

The glass antenna disclosed in JP 2001-136013 A is shown in FIG. 1 hereof. In this glass antenna, the VHF antenna (FM antenna) 2 has an antenna element 4 comprising a conductor element that is bent in a U shape in order to ensure the antenna length (λ/4=approximately 830 mm) that is required for reception in the VHF band. One end of the U-shaped antenna element 4 is connected to a rectangular feeder terminal 6. The other end of the antenna element 4 is grounded to a rectangular ground terminal 8. The reference symbol 10 indicates a side window glass of the vehicle.

The feeder terminal 6 is connected to a feeder line (coaxial cable) 14. The ground terminal 8 is connected to a conductor (vehicle body) 12 that forms the opening used for the window glass 10 via a feeder line (wire) 15.

The glass antenna disclosed in JP 2001-136013 A has a ground terminal 8 in order to match the impedance of the glass antenna with the impedance of the feeder line 14. In this glass antenna, since a ground terminal 8 connected to the vehicle body 12 is provided on the window glass 10, the glass antenna has an antenna impedance suitable for antenna reception even if the area of the vehicle window glass is small, and use in the side window glass of an automobile is possible.

However, in the case of vehicles in which the area of the window glass is even smaller, e.g., 0.10 to 0.15 $m^2$ (narrow area) matching with the impedance of the feeder line cannot be achieved, and an effective reception performance cannot be obtained.

SUMMARY OF THE INVENTION

It is an object of the present invention to provide a glass antenna which has superior impedance matching characteristics and a good reception sensitivity even with antennas established when the opening in the window glass is narrow.

According to an aspect of the present invention, there is provided a glass antenna for a vehicle provided on a window glass, which antenna comprises: a single feeder terminal provided on the window glass and connected to a receiver; first and second ground terminals provided on the window glass and connected to a conductor defining an opening for fitting the window glass; and a single antenna element having a plurality of conductor elements to which the feeder terminal and the first and second ground terminals are connected.

Preferably, minimum lengths of the conductor elements that connect the feeder terminal and the first and second ground terminals are respectively (⅛) λκ to (⅝) λκ, where λ is the wavelength, and κ is the wavelength contraction rate of the glass.

Desirably, minimum lengths of the conductor elements between the first ground terminal and the second ground terminal are (⅛) λκ to λκ.

In a preferred form, the antenna element further includes conductor elements having one end connected to the feeder terminal or ground terminals and having all opposite end being open.

Preferably, the antenna element comprises: a first rectilinear conductor element connected to the first ground terminal; a second rectilinear conductor element connected to the second ground terminal; a third rectilinear conductor element connected to the feeder terminal; and first and second connecting conductor elements for connecting two of the first, second and third rectilinear conductor elements, the first, second and third rectilinear conductor elements being parallel to each other.

Desirably, the antenna element further comprises at least one auxiliary conductor element which is parallel to the first second and third rectilinear conductor elements and is connected in parallel.

In a preferred form, the feeder terminal and the first and second ground terminals are installed in at least a lower side portion of the window glass.

Matching of the antenna impedance (radiation impedance of the feeder terminal part) resulting from the addition of ground terminals is accomplished by allowing a portion of the current flowing through the antenna element to escape via the ground terminals, so that the concentration of current in the feeder terminal is minimized, and a drop in the antenna impedance is prevented. Accordingly, since the lengths of the antenna elements from the feeder terminal to the two ground terminals are respectively adjusted so that the antenna impedance is matched with the impedance of the feeder line, the impedance matching characteristics are superior, and a good reception sensitivity can be obtained, even in the case of a small area that has not allowed impedance matching in the past.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 2:
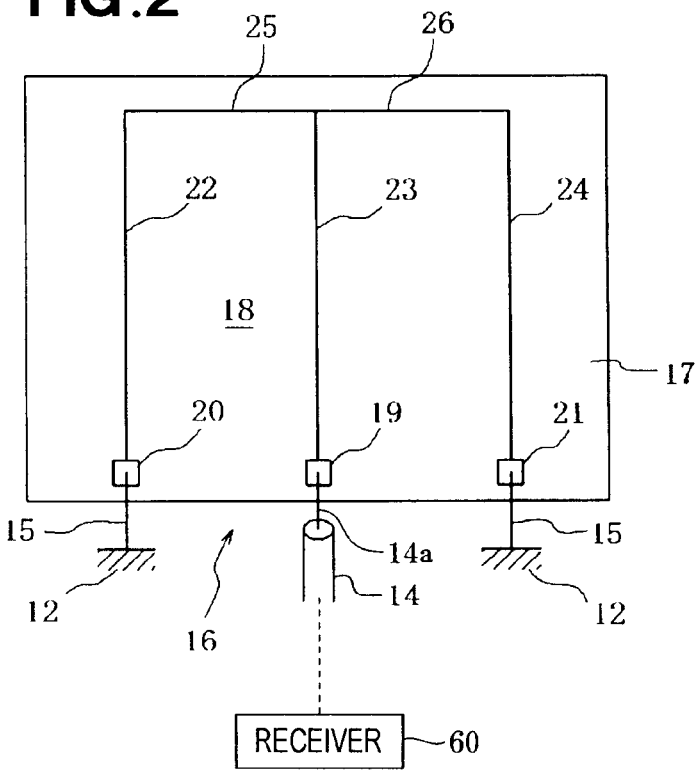
FIG. 2 is a schematic view illustrating a glass antenna according to a first embodiment of the present invention.

Reference is now made to FIG. 2 showing a glass antenna according to the first embodiment, which is designed for FM radio reception.

The glass antenna 16 of the first embodiment comprises an antenna element 18 that is formed on the surface of a window glass 17, a feeder terminal 19) that is connected to the antenna element 18, and first and second ground terminals 20 and 21 that are connected to the antenna element 18.

The feeder terminal 19 and the first and second ground terminals 20 and 21 are rectangular conductors that are formed on the surface of the window glass 17.

The antenna element 18 comprises parallel first, second and third rectilinear conductor elements that extend from the respective terminals 19, 20 and 21, and first and second connecting conductor elements 25 and 26 that connect these rectilinear conductor elements.

The feeder terminal 19 is connected to the central conductor 14*a* of a coaxial cable 14. The outer conductor of the coaxial cable 14 is connected to the vehicle body 12 in the vicinity of the opening used for the window glass 17. The other end of the coaxial cable 14 is connected to a receiver 60.

The first and second ground elements 20 and 21 are respectively connected via feeder lines (wires) 15 to the conductor (vehicle body) 12 in which the opening for the window glass is formed.

The distances (lengths) of the conductor elements 23, 25, and 22 running between the feeder element 19 and the first ground element 20, and the distances (lengths) of the conductor elements 23, 26, and 24 running between the feeder terminal 19 and the second ground terminal 21, are respectively (⅛) λκ to (⅝) λκ. Here, λ is the wavelength, and K is the wavelength contraction rate of the glass, which is approximately 0.7.

The distances (lengths) of the conductor elements 22, 25, 26, and 24 running, between the first ground terminal 20 and second ground terminal 21 are (⅛) λκ to λκ.

Generally, the impedance of an antenna that is grounded at one end is expressed mainly as the inductance (L) component in cases where the length of the antenna is (⅛) λκ to (¼) λκ, and is expressed mainly as the capacitance (C) component in cases where the length of the antenna is (¼) λκ to (½) λκ. In order to match the antenna impedance by adjusting these two components L and C, it is desirable that the length of the antenna in the first embodiment be set at (⅛) λκ to (⅝) AK as described above. Furthermore, it is desirable that the length as seen from the common feeder point be set at (⅛) λκ to AK as described above.

Figure 3:
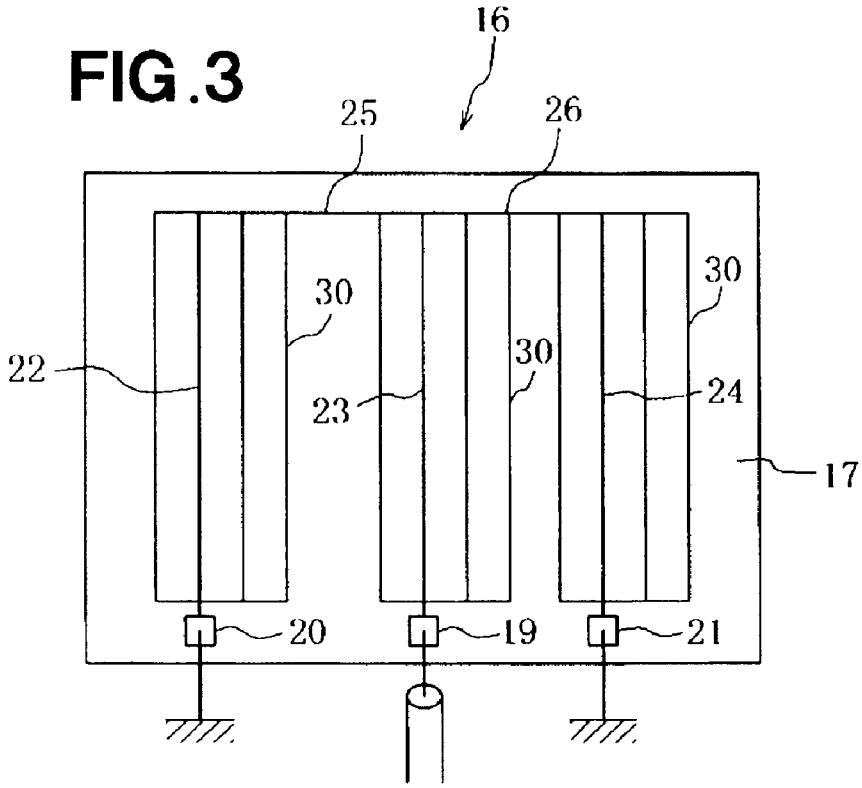
FIG. 3 is a schematic view illustrating a glass antenna according to a second embodiment of the present invention.

FIG. 3 shows a glass antenna according to a second embodiment. In the glass antenna shown 16 of the second embodiment, at least one auxiliary conductor element 30 (and three auxiliary conductor elements 30, 30, 30 in the example shown in the drawings) are respectively connected in parallel to the first, second and third rectilinear conductor elements 22, 23, and 24 of the first embodiment shown in FIG. 2. The remaining construction is the same as that of the second embodiment shown in FIG. 2. This embodiment will be described with the same reference symbols assigned to the same constituent elements.

The minimum length from the feeder terminal 19 to the first ground terminal 20 was 780 mm, the minimum length from the feeder terminal 19 to the second ground terminal 21 was 750 mm, and the length from the first ground terminal 20 to the second ground terminal 21 was 900 mm. These lengths match the conditions determined from the wavelength when 95 MHz (λ=3156 mm) was set as the target wavelength.

Figure 4:
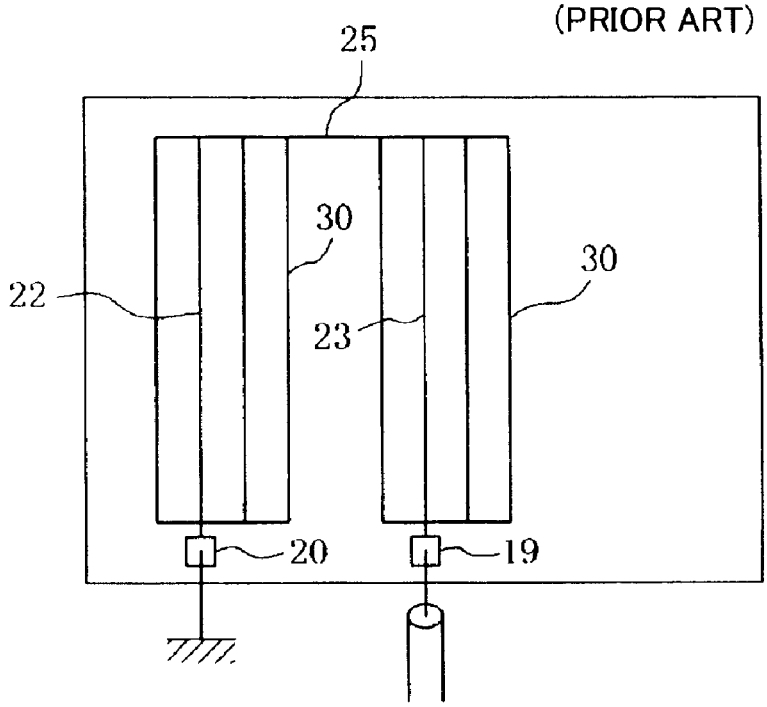
FIG.4 (PRIOR ART)
FIG. 4 is a schematic view illustrating a conventional glass antenna for comparison with the glass antenna according to the second embodiment.

The radiation characteristics of a glass antenna having the above antenna pattern were determined. For purposes of comparison, a glass antenna having the antenna pattern of the prior art shown in FIG. 4 was prepared. This conventional glass antenna corresponds to an antenna in which a second ground terminal 21, a third conductor element 24, and an auxiliary conductor element 30 connected in parallel with this are formed in the glass antenna of the second embodiment shown in FIG. 3. In FIG. 4, constituent elements that are the same as in FIG. 3 will be described with the same reference symbols assigned.

Figure 1:
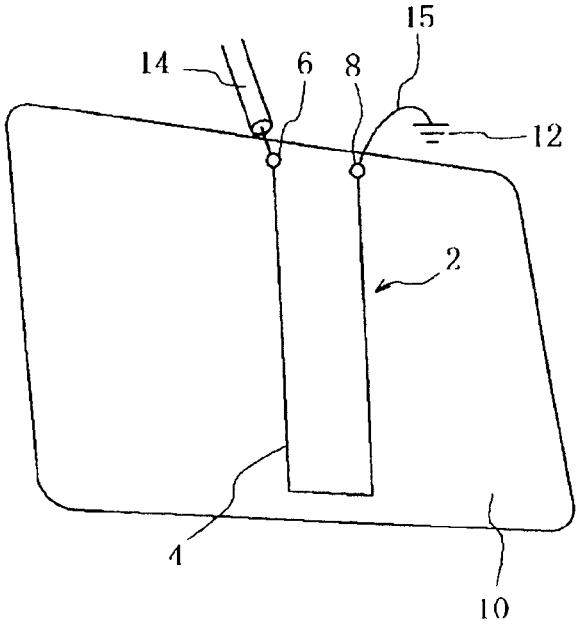
FIG.1 (PRIOR ART)
FIG. 1 is a schematic view illustrating a conventional glass antenna.
Figure 5:
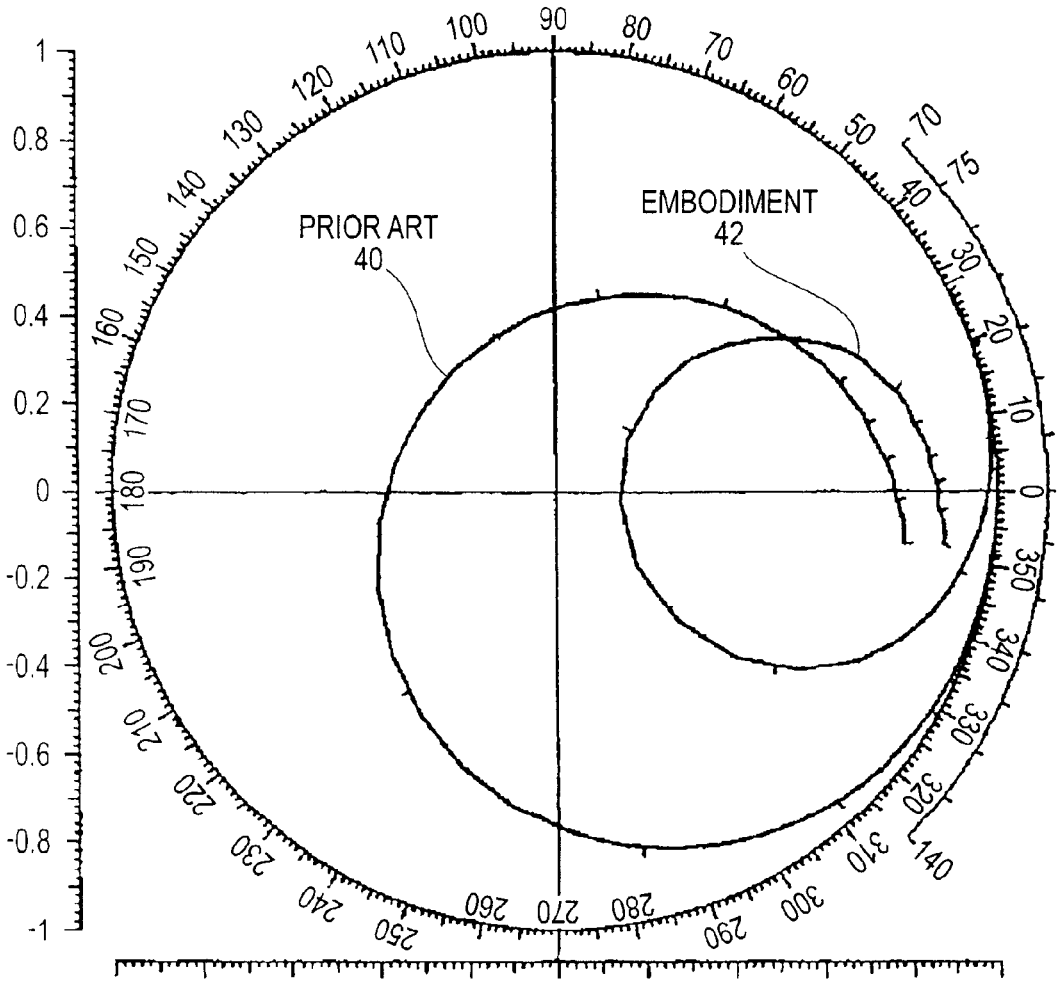
FIG. 5 illustrates impedance characteristics of the glass antenna according to the first embodiment shown in FIG. 2 and of the conventional glass antenna shown in FIG. 1.

FIG. 5 shows the antenna radiation impedance characteristics of the glass 10 antenna of the first embodiment shown in FIG. 1, and the conventional glass antenna shown FIG. 4. In FIG. 5, the curve 40 shows the antenna radiation characteristics of the prior art shown in FIG. 4, and the curve 42 shows the antenna radiation characteristics of the first embodiment.

In the prior art, as is clear from FIG. 5, the antenna impedance characteristics tend to be lower than the impedance of the receiver connected to the antenna, and matching cannot be sufficiently accomplished. However, it is seen that the impedance characteristics of the antenna of the first embodiment are far better than this, and that matching is achieved.

Figure 6:
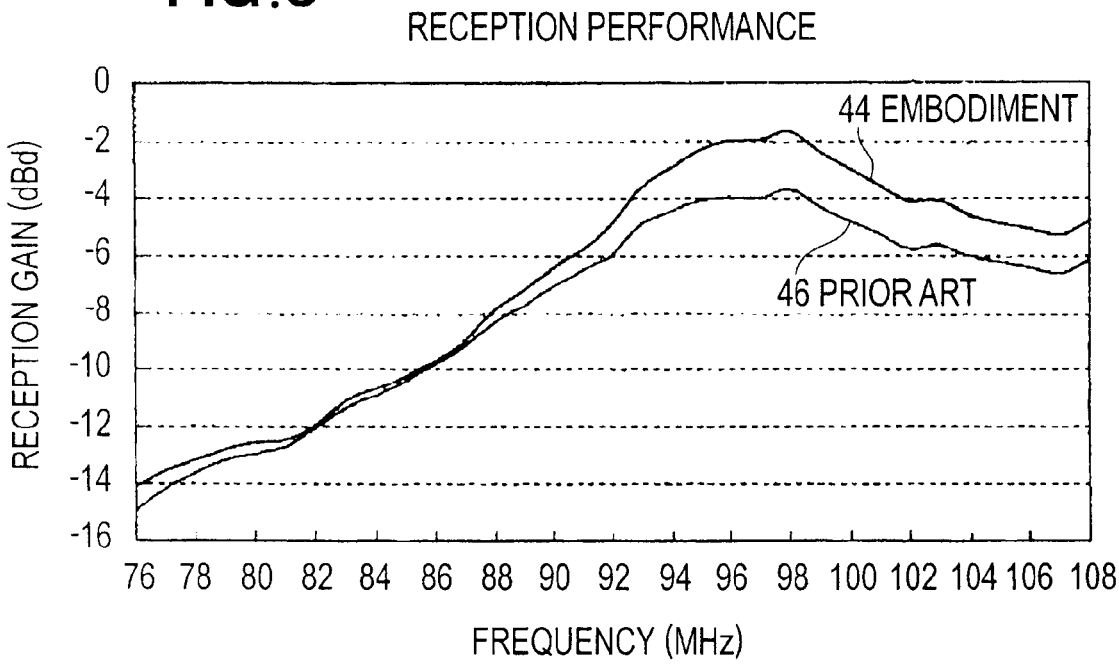
FIG. 6 is a graph showing reception performance of the glass antenna as it is mounted on a vehicle.

FIG. 6 shows the reception performance obtained when a glass antenna is mounted on a vehicle. This reception performance shows the mean values of the reception gain in all directions in a horizontal plane. In FIG. 6, the curve 44 shows the reception performance of the glass antenna of the second embodiment shown in FIG. 3, and the curve 46 shows the reception performance of the conventional glass antenna shown in FIG. 4.

The reception performance at 95 MHz, the average reception performance at 99 to 108 MHz, and the average reception performance at 76 to 108 MHz determined from the graph shown in FIG. 6 are shown in Table 1.

TABLE 1

| | Prior Art | Present Invention |
|---|---|---|
| 95 MHz reception performance | −4.0 dBd | −2.3 dBd |
| 88 to 108 MHz average | −5.5 dBd | −4.0 dBd |
| 76 to 108 MHz average | −7.3 dBd | −6.0 dBd |

In regard to the reception sensitivity as well, as is clear from this Table 1, the glass antenna of the present embodiment shows a reception performance superior to that of a conventional glass antenna.

As is shown in FIGS. 2 and 3, the glass antenna of the present invention basically tunes a conductor element in the vertical direction and a conductor element in the horizontal direction. However, the present invention is not limited to such an antenna pattern. The feeder terminal and ground terminals may also be provided on the lateral side parts instead of the lower side part of the window glass.

Figure 7A:
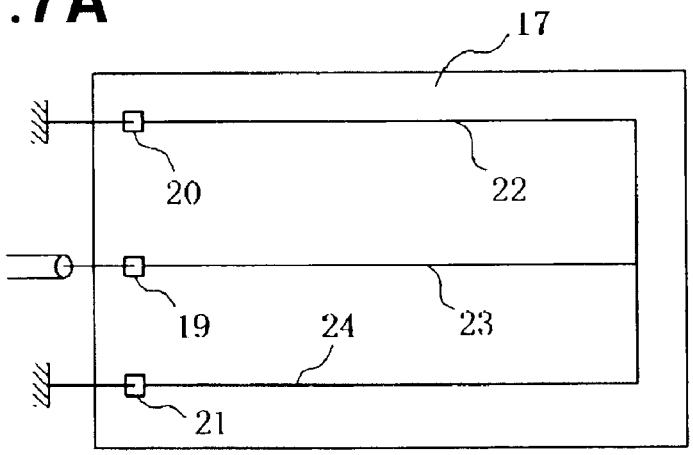
FIGS. 7A through 7C show a glass antenna according to a third embodiment of the present invention.
Figure 7B:
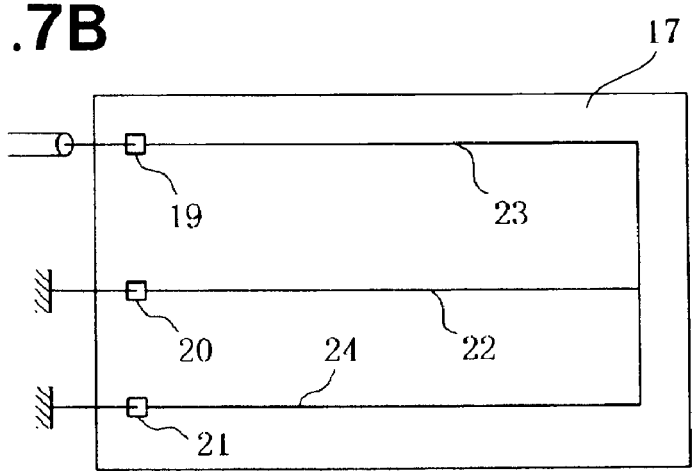
Figure 7C:
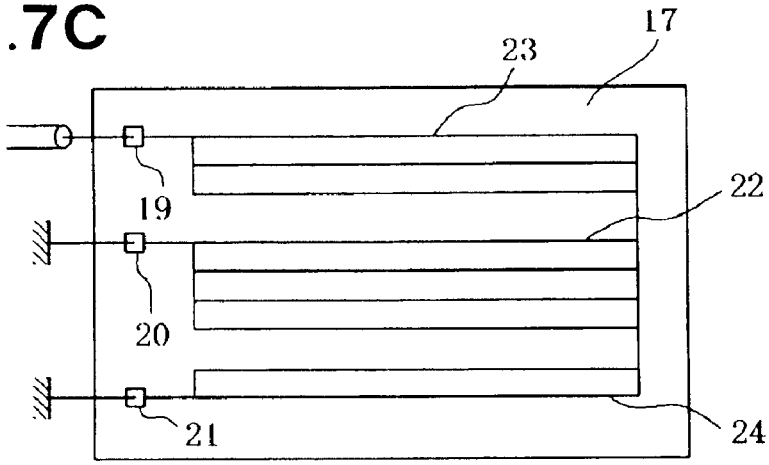

The glass antenna of the third embodiment shown in FIGS. 7A through 7C is conceivable as an example of such a glass antenna.

The glass antenna of the third embodiment shown in FIG. 7A shows a modification of the first embodiment shown in FIG. 2. The first and second ground terminals 20 and 21 and the feeder terminal 19 are provided on the left side part of the window glass 17.

The glass antenna shown in FIG. 7B has a feeder terminal 19, a first ground terminal 20, and a second ground terminal 21 installed in the stated order from the top on the left side part of the window glass 17.

The glass antenna shown in FIG. 7C is the glass antenna shown in FIG. 7B, wherein it least one auxiliary conductor element 30 is connected parallel to and in parallel with each of the conductor elements 23, 22, and 24 connected to the respective terminals. It is not necessary that the feeder terminal and ground terminals be provided on only a single side of the window glass 17; these terminals may also be dispersed on arbitrary side parts. The glass antenna of the fourth embodiment shown in FIGS. 8A through 8D is conceivable as an example of such a glass antenna.

Figure 8A:
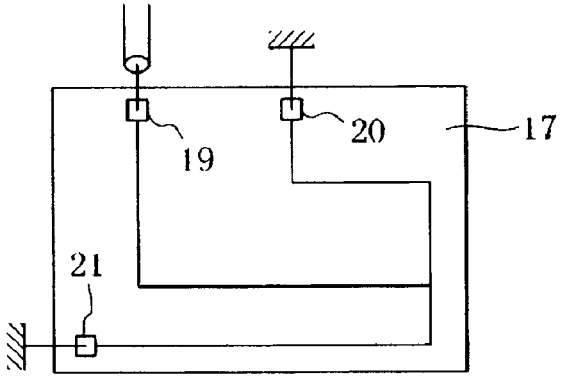
FIGS. 8A through 8D show a glass antenna according to a fourth embodiment of the present invention.

FIG. 8A shows an example in which the first ground terminal 20 and feeder terminal 19 are provided on the upper side part of the window glass 17, and the second ground terminal 21 is provided on the left side part of the window glass 17.

Figure 8B:
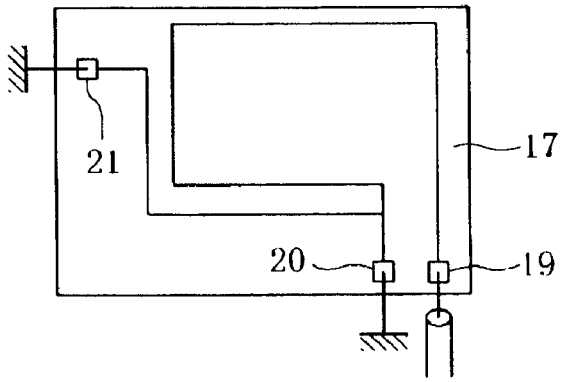

FIG. 8B shows an example in which the first ground terminal 20 and feeder terminal 19 tire provided on the lower side part of the window glass 17, and the second ground terminal 21 is provided on left side part of the window glass 17.

Figure 8C:
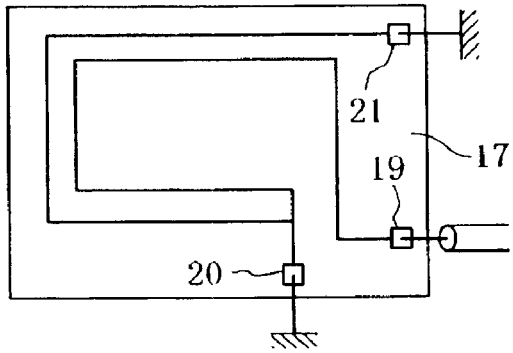

FIG. 8C shows an example in which the first ground terminal 20 is provided on the lower side part of the window glass 17, and the second ground terminal 21 and feeder terminal 19 are provided on the right side part of the window glass 17.

Figure 8D:
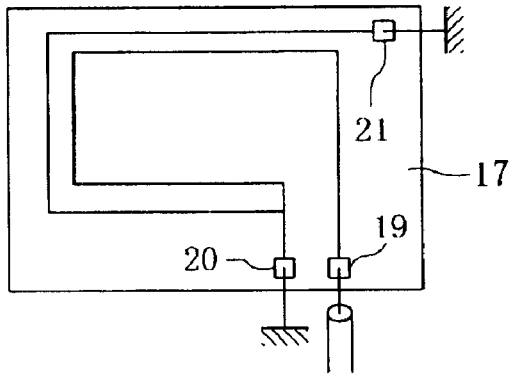

FIG. 8D shows an example in which the first ground terminal 20 and feeder terminal 19 are provided on the lower side part of the window glass 17, and the second ground terminal 21 is provided on the right side part of the window glass 17.

In order to contribute to impedance matching, it would also be possible to install conductor elements with one end connected and the other end open. Such a glass antenna is indicated as the glass antenna of the fifth embodiment shown in FIGS. 9A through 9C.

Figure 9A:
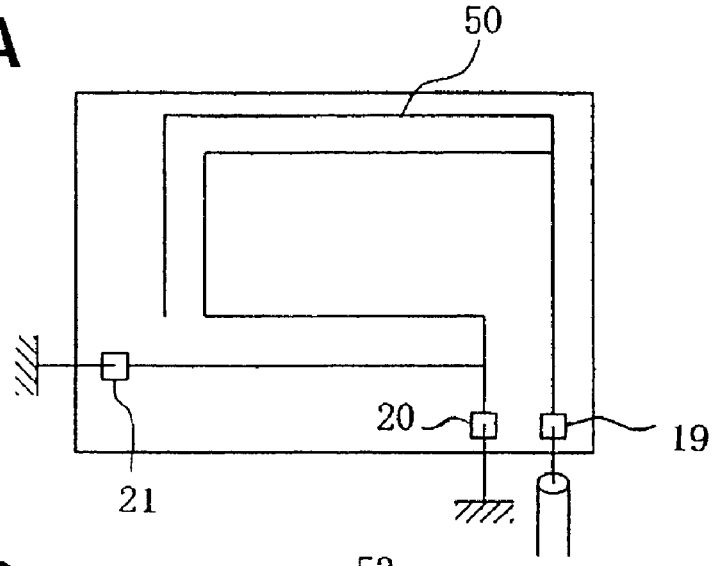
FIGS. 9A through 9C show a glass antenna according to a fifth embodiment of the present invention.
Figure 9B:
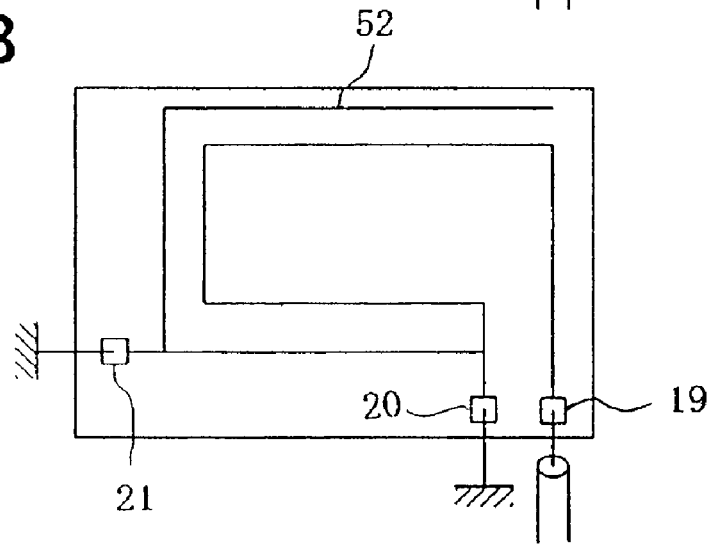
Figure 9C:
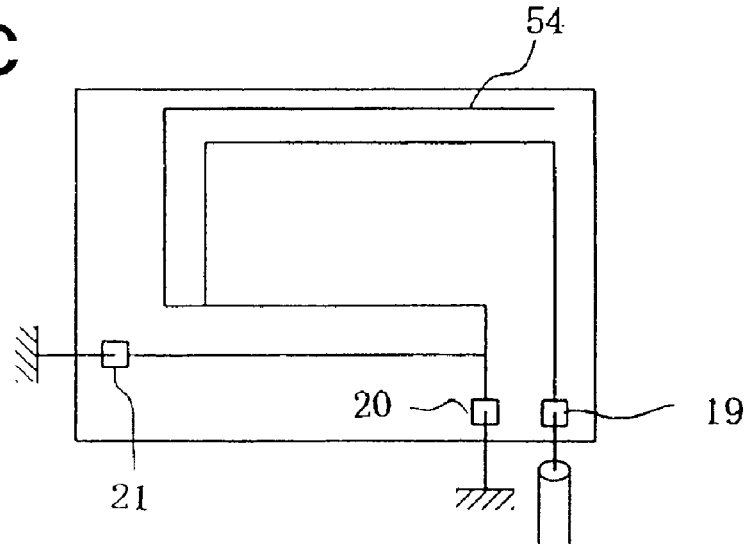

The glass antennas shown in FIGS. 9A, 9B, and 9C have conductor elements 50, 52 and 54 respectively connected to the antenna pattern shown in FIG. 8B. It is desirable that the length of such conductor elements be set at $(1/16)\lambda\kappa$ to $(1/4)\lambda\kappa$.

Table 2 compares the reception performance of a glass antenna in which such open conductor elements are not installed and a glass antenna in which these open conductor elements are installed. It is seen that the reception performance is improved in the 88 to 108 MHz band.

TABLE 2

| | Without open antenna element | With open antenna element |
|---|---|---|
| 95 MHz reception performance | −2.3 dBd | −2.4 dBd |
| 88 to 108 MHz average | −5.5 dBd | −5.0 dBd |
| 76 to 108 MHz average | −7.3 dBd | −7.6 dBd |

In the above embodiments, coaxial cables and wires were connected to the feeder terminal and ground terminals; however, the present embodiment is not limited to this. It would also be possible to connect devices.

Obviously, various minor changes and modifications of the present invention are possible in light of the above teaching. It is therefore to be understood that within the scope of the appended claims the invention may be practiced otherwise than as specifically described.

What is claimed is:

1. A glass antenna, for a vehicle provided on a window glass, comprising:

a single feeder terminal provided on the window glass and connected to a receiver;

first and second ground terminals provided on the window glass and connected to a conductor, said conductor defining an opening into which the window glass is fitted; and a single antenna element having a plurality of conductor elements on the window glass to which the feeder terminal and the first and second ground terminals are connected, wherein minimum lengths of the conductor elements that connect the feeder terminal and the first and second ground terminals are respectively $(1/8)\lambda\kappa$ to $(4/8)\lambda\kappa$, where $\lambda$ is the wavelength, and $\kappa$ is the wavelength contraction rate of the glass.

2. The glass antenna of claim 1, wherein minimum lengths of the conductor elements between the first ground terminal and the second ground terminal are $(1/8)\lambda\kappa$ to $\lambda\kappa$.

3. The glass antenna of claim 1, wherein the antenna element includes conductor elements having one end connected to the feeder terminal or ground terminals and having an opposite end that is open.

4. The glass antenna of claim 1, wherein the antenna element comprises:

a first rectilinear conductor element connected to the first ground terminal;

a second rectilinear conductor element connected to the second ground terminal;

a third rectilinear conductor element connected to the feeder terminal; and first and second connecting conductor elements for connecting two of the first, second and third rectilinear conductor elements, the first, second and third rectilinear conductor elements being parallel to each other.

5. The glass antenna of claim 4, wherein the antenna element comprises at least one auxiliary conductor element which is parallel to the first second and third rectilinear conductor elements and is connected in parallel.

6. The glass antenna of claim 1, wherein the feeder terminal and the first and second ground terminals are provided in at least a lower side portion of the window glass.

* * * * *